US005892427A

United States Patent [19]

Handcock

[11] Patent Number: 5,892,427

[45] Date of Patent: Apr. 6, 1999

[54] CURRENT LIMITING HIGH VOLTAGE FUSE

[75] Inventor: Harold John Handcock, Nottinghamshire, United Kingdom

[73] Assignee: Cooper Technologies Company, Houston, Tex.

[21] Appl. No.: 65,537

[22] Filed: Apr. 24, 1998

[51] Int. Cl.[6] ..... H01H 85/11; H01H 85/175

[52] U.S. Cl. ..... 337/229; 337/227; 337/160; 337/161

[58] Field of Search ..... 337/227, 164, 337/160, 161, 162, 163, 159, 295, 296, 279, 228, 229, 246, 247, 248, 256, 293

[56] References Cited

U.S. PATENT DOCUMENTS

| | | | |
|---|---|---|---|
| 2,639,350 | 5/1953 | Cox | 337/161 |
| 3,251,968 | 5/1966 | Cameron | 337/244 |
| 3,835,431 | 9/1974 | Rosen et al. | 337/161 |
| 3,864,655 | 2/1975 | Kozacka | 337/160 |
| 4,357,588 | 11/1982 | Leach et al. | 337/160 |
| 4,486,734 | 12/1984 | Leach | 337/162 |

*Primary Examiner*—Leo P. Picard
*Assistant Examiner*—Anatoly Vortman
*Attorney, Agent, or Firm*—Burns, Doane, Swecker & Mathis LLP

[57] ABSTRACT

A current limiting high voltage fuse wherein a hollow body 1 has conductive caps 2, 3 at either end and is filled with silica sand. A plurality of fusible strips 8 extend between the two caps. Each fusible strip has a low melting alloy spot 10. The locations of the spots are staggered and are positioned substantially one third of the way along a respective fusible strip. In an alternative construction, the fusible strips 13, 14 are wound around a pair of coaxial formers 11, 12, with the fusible strips 14 wound around the central former 12 having a smaller cross section than the fusible strips 13 wound around the outer former 11.

9 Claims, 3 Drawing Sheets

CURRENT LIMITING HIGH VOLTAGE FUSE

The present invention relates to a current limiting high voltage fuse.

In prior art designs, such fuses have a body of high strength material, such as aluminous porcelain or resin bonded glass fibre. Metal terminating members are attached to the ends of the body and to these, conducting fuse elements strips of silver are attached at each end. For fuses rated much above 5 kV, the elements strips are wound in helical fashion on an insulated former within the fuse body.

Such fuses normally include spots of a low melting alloy overlaid on each fuse element. These spots are referred to in the art as "M"-Effect spots. These overlay spots have the effect of ensuring that the fuse elements do not have to reach the high melting temperature of the conducting fuse element strips during operation to clear low fault currents. Such high temperatures, especially with a fuse of a very large current rating, could well result in damage to associated fuse mounts or other adjacent equipment. Typically, the element strips are silver having a melting temperature of 960° C., and the "M"-Effect spots are a tin alloy which has the effect of limiting the maximum body temperature of fuse to approximately 160° C. during operation. For maximum operating efficiency, the "M"-Effect spots are placed at the centre of each element where, during normal service conditions, the temperature is generally highest.

The prior art arrangement has the drawback that, under low fault conditions, initial melting of the many parallel fuse elements occurs in a small concentrated area at the centre of the fuse body. During subsequent arcing within the fuse while the fault is being cleared, these central areas develop the largest volumes of fulgurite (fused silver sand slag). A fuse of large current rating and low minimum breaking current has, of necessity, many closely spaced elements in parallel. The aforementioned heavy growth of fulgurite at the centre of the fuse results in the individual modules merging to form one single clump of large mass which causes excessive local heating and has been known to lead to the formation of a semi-conducting material causing failure of the fuse under such low undercurrent conditions.

The demand for high voltage fuses which operate at ever larger current ratings puts pressure on designers to increase the number of elements strips in the fuse. In order to avoid the above mentioned failure, the physical size of the fuse must therefore increased. However, there is a conflicting demand for the fuses to be contained in single fuse tube of standardized dimensions in order to avoid use of excessively large fuse mounting cubicles.

A further prior art arrangement is that disclosed in GB-A-2297003 which relates to a fuse element having a support body on which conductors are screened printed helically around the outer surface. A group of conductors are merged together so as to form a bridge, and a spot of low melting alloy is provided on the bridge near the ends of the fuse.

The present invention is directed at providing a current limiting high voltage fuse having low minimum breaking current and with an increased current rating which is capable of being fitted in the same size tube as a prior art fuse of much lower current rating.

According to a first aspect of the present invention a current limiting high voltage fuse comprises an elongate hollow main body of insulating material having a main axis and having two axially spaced apart ends, granulated silica sand filling the main body, a respective terminal member at each end of the main body, a plurality of fusible strips extending between the two terminal members, and a respective spot of low melting alloy on each fusible strip, wherein the spots of low melting alloy are staggered in the direction of the main axis of the body, and wherein the spots of low melting alloy are spaced from the nearest end of the respective fusible strip by a distance of between one fifth and two fifths of the length of the respective strip.

This staggered arrangement of low melting alloy spots allows the current rating of the fuse to be improved for a given size of fuse body without causing excessive local heating. The lumps of fulgurite formed are now distributed along and around the fuse instead of being concentrated at the centre. By arranging the low melting alloy spots spaced from the nearest end of a respective strip by a distance of between one fifth and two fifths of the length of the strip, the spots are still positioned at a location which, although not quite as hot as the exact centre of the fuse, will still be very close to this temperature, and will be significantly hotter than the arrangement of GB-A-2297003 where the low melting alloy spots are positioned near the end of the fuse deliberately to obtain a longer pre-arcing time. The optimum position for the low melting alloy spot has been found to be substantially one third of the distance along the fusible strip.

The staggered arrangement is preferably such that for any two adjacent fusible strips, the first strip has a low melting alloy spot which is spaced from one end by between one fifth and two fifths of the length of the fusible strip, while the low melting alloy spot of the second strip is spaced from the other end by between one fifth and two fifths of the length of the fusible strip. With this arrangement, the spots of fulgurite formed on adjacent elements are staggered so that no two adjacent elements form adjacent fulgurite lumps.

Preferably, the distance from a low melting alloy spot to the closest end of the respective fusible strip is equal for all fusible strips. This facilitates manufacture, as only one type of fusible strip needs to be produced. The fusible strips are then arranged in alternate configuration when the fuse is assembled.

Conventionally in such prior art high voltage fuses, the sand used is, for example, 44–100 mesh to BS410. It has been found, that with the present invention, a coarser sand, such as 25–52 mesh to BS410 (i.e. having a diameter of between 300 and 600 microns) is advantageous. This coarser sand is better able to disperse the ionised gas products during arcing and hence leads to shorter arcing times.

It has also been found advantageous to provide the fusible strips with a pattern of plurality of long and short reduced cross-sectional areas along each strip. Such an arrangement is, for example, as disclosed in GB 1326535. Such an arrangement reduces the value of fault current at which multiple arcs are set up, and hence enables General Purpose breaking performance to be achieved with a smaller than usual number of parallel elements. Such a reduction in number of elements gives benefits in terms of greater spacing between elements and hence less risk of fulgurite merging during fault clearance.

High voltage fuses for use at potentials much above 5 kV usually have conducting element strips wound helically upon insulated formers within the fuse body. This construction is necessary in order to allow use of element strip lengths greater than that of the actual fuse body itself. Element lengths are typically about 0.75 meter for fuses of 12 kV rating. Helical winding on a former allows the fuse body length to be kept down to less than a third of this length.

For fuses of higher current rating it is common to wind many element strips in parallel on the insulated former.

However, the finite surface area of the former sets a limit to how many elements can be wound-on in this way. This, in turn, sets a limit to the maximum current rating achievable in a fuse of given overall dimensions.

One solution to this problem is to place a second former of lesser diameter concentrically within the bore of the main former, wound with a further set of elements in parallel. In this way, a further increase in rating of as much as 50% is possible within a fuse of given dimensions.

However, this solution can give rise to a technical problem associated with the fuse interrupting process. During this process, arcing within the fuse converts the conducting elements strips and surrounding quartz sand filler into fulgurite. These quickly cool down and become good insulating material to prevent the fuse re-striking. Nevertheless for the few milliseconds while arcing is in progress, the thermal and mechanical stress on the fuse is considerable.

This effect can be most severe in the small space between inner and outer element formers. It is possible for the expanding hot lumps of fulgurite formed on the inner former to press so hard on the inner wall of the surrounding outer former as to burst it and cause the fuse to fail.

One way in which this problem can be addressed is by using the staggered arrangement of "M"-Effect spots according to the first aspect of the present invention. Additionally or alternatively, the fuse can be constructed in accordance with a second aspect of the present invention.

According to a second aspect of the present invention a current limiting high voltage fuse comprises an elongate hollow main body of insulating material having a main axis and having two axially spaced apart ends, granulated silica sand filling the main body, a respective terminal member at each end of the main body, a hollow outer former extending axially between the two ends of the main body, an inner former within the outer former and extending axially between the two ends of the main body, a plurality of first fusible strips helically wound around the hollow outer former and extending between the two terminal members, and a plurality of second fusible strips helically wound around the inner former and extending between the two terminal members, wherein the cross section of the first fusible strips is greater than the cross section of the second fusible strips.

By this means the diameter of the fulgurite lumps in this sensitive area can be kept down to a size which will not damage the outer former.

The required reduction in the cross sectional area of the second fusible strips will vary according to the particular fuse design and rating, but reductions of between 10–25% appear optimum.

The total current rating obtained may then be slightly less than for a fuse with uniform strip cross sections, but is still at least 30–40% higher than for a conventional fuse of single former construction.

Examples of fuses constructed in accordance with the present invention will now be described with reference to the accompanying drawing, in which.

Figure 1:
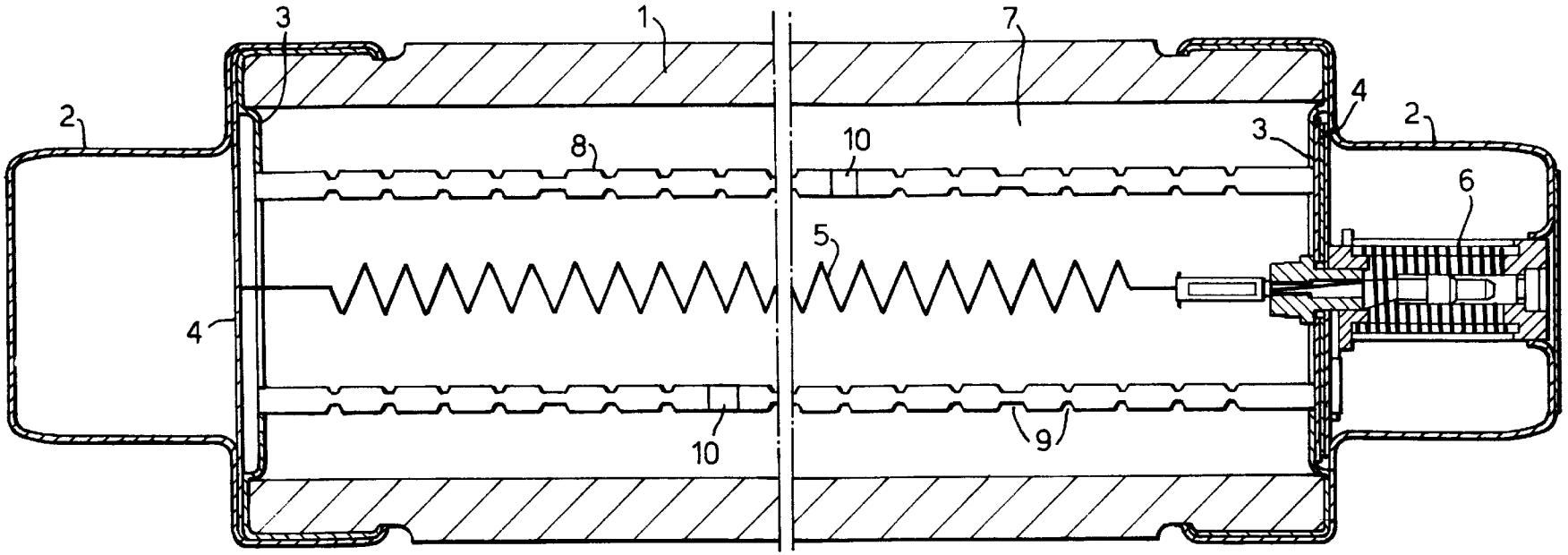
FIG. 1 is a cross-section through a fuse according to a first aspect of the present invention.

The fuse of FIG. 1 comprises an elongate tubular body 1 of high strength insulating material, such as aluminous porcelain or resin bonded glass fibre. Respective outer metal end caps 2 enclose each end of the body 1 to provide contact members. Respective inner metal caps 3 which are in electrical contact with adjacent outer end caps 2 are provided at each end of the body 1. A respective reinforcing disk 4 is provided between each pair of outer 2 and inner 3 caps.

A conventional fuse striker may be provided and comprises a higher resistance wire coil 5 and striker bar 6. The striker assembly operates in a conventional manner to provide a visual indication that the fuse has operated.

The space bounded by the tubular body 1 and inner end caps 3 is filled with the silica sand filler 7, for example, 25–52 mesh. Extending between the two inner caps 3 are a plurality of silver conducting fuse element strips 8. Although only two of the strips are illustrated, more are provided and are generally spaced about the circumference of a circle centred on the main axis of the fuse. In order to accommodate a greater number of strips, one set of strips may be arranged around the circumference of a circle centred on the main axis of the fuse having a first diameter, while a second set of strips may be arranged around the circumference of a second coaxial circle of a larger diameter. For fuses rated much above 5 kV, the element strips may be wound in a helical fashion on an insulated former of conventional design. Again, to increase the number of strips, one insulated former on which the strips are wound in helical fashion may be provided within a larger former on which further strips are helically wound. When using one or more insulated formers, the space surrounding the or each former is filled with granulated silica sand.

In all cases the strips are provided with a series of notches 9 of various lengths, for example as disclosed in GB 1326535.

Each strip 8 has a low melting point alloy spot 10 of, for example, tin alloy. The spot of low melting alloy is spaced along the length of the strip substantially one third of the distance from one end. The fuse element strips 8 are arranged so that adjacent strips have their low melting alloy spots arranged towards opposite ends of the fuse.

Without the inventive arrangement, a prior art fuse of given dimensions and having General Purpose Performance would have a maximum current rating of, for example, 250A, while, the same size fuse according to the present invention can have a current rating of up to 450A.

Figure 2:
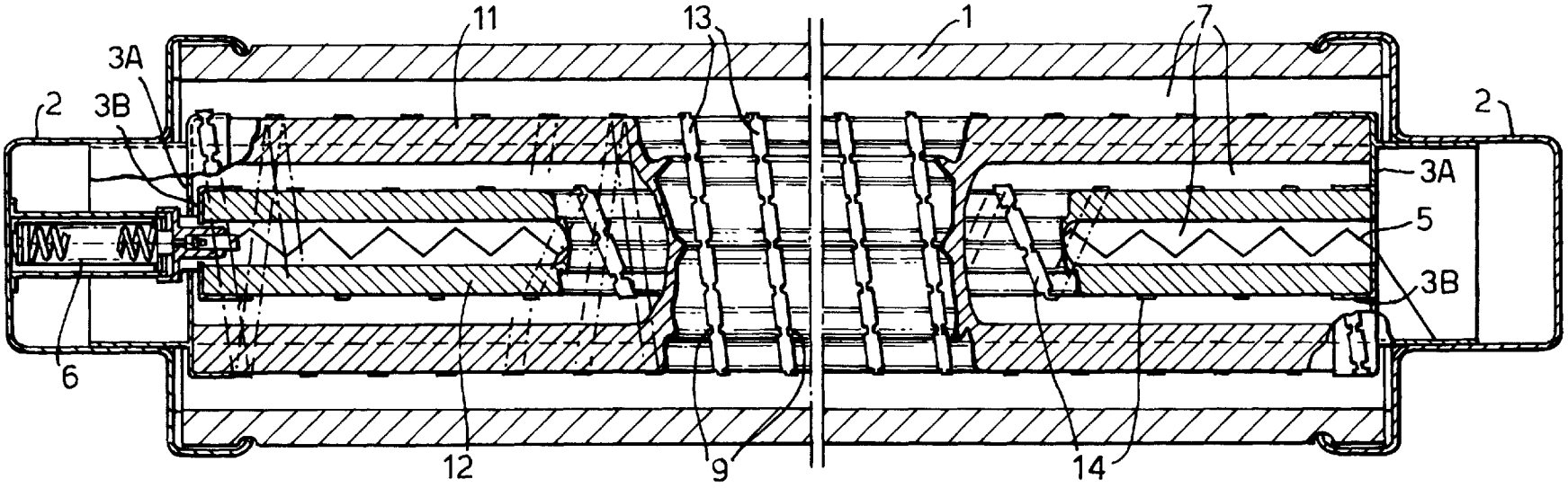
FIG. 2 is a schematic cross-section through a fuse constructed in accordance with a second aspect of the present invention.
Figure 3:
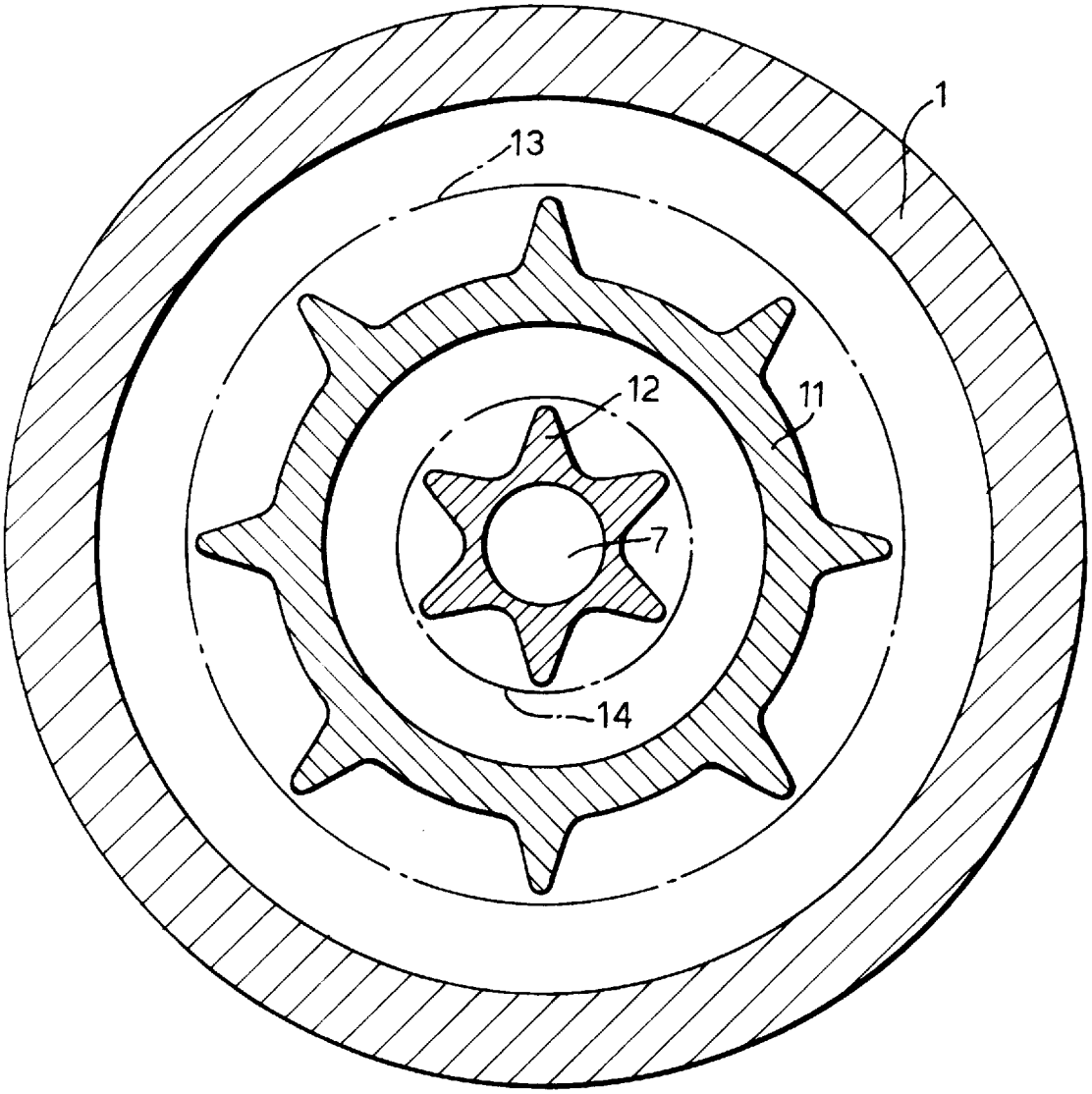
FIG. 3 is a cross-section of the fuse of FIG. 2.

The fuse of FIGS. 2 and 3 is similar in construction to that shown in FIG. 1, and the same reference numerals have been used where appropriate. The difference is that, instead of the plurality of axially extending fuse element strips 8 of FIG. 1, the fuse of FIGS. 2 and 3 is provided with a hollow outer former 11 which has a star-shape cross section and an inner former 12 which has a star-shape cross section within the hollow of the outer former 11. The inner former 12 is also hollow to accommodate the wire coil 5. All of the internal voids are filled with the silica sand filler 7. The outer hollow former 11 is closed at both ends by first inner metal caps 3A, while the inner former 12 is closed at both ends by second inner metal caps 3B. At each end, the first and second inner metal caps 3A, 3B are electrically connected to one another and to the respective outer end cap 2.

Helically wound around the hollow outer former 11 are a plurality of first fusible strips 13 extending between and electrically connected between the two first inner end caps 3A. Similarly helically wound around the inner former 12 are a plurality of second fusible strips 14 which extend between the two second inner end caps 3B. Both sets of fusible strips are provided with notches 9 and "M"-effect spots (not shown in FIG. 2).

Although not apparent from FIG. 2, the thickness (i.e. the dimension in the direction perpendicular to the plane of the paper of FIG. 2) of the second fusible strips is less than that of the first fusible strips. Thus, during the fuse interrupting process, the fulgurite lumps which are formed in the gap between the two formers 11, 12 can be kept down to a size which will not damage the outer former 11.

I claim:

1. A current limiting high voltage fuse comprising an elongate hollow main body of insulating material having a main axis and having two axially spaced apart ends, granulated silica sand filling the main body, a respective terminal member at each end of the main body, a plurality of fusible strips extending between the two terminal members, and a respective spot of low melting alloy on each fusible strip, wherein the spots of low melting alloy are staggered in the direction of the main axis of the body:

further comprising a hollow outer former extending axially between the two ends of the main body, an inner former within the outer former and extending axially between the two ends of the main body, a plurality of first fusible strips helically wound around the hollow outer former and extending between the two conductors, and a plurality of second fusible strips helically wound around the inner former and extending between the two conductors.

2. A fuse according to claim 1, wherein each low melting alloy spot is positioned substantially one third of the distance along the fusible strip.

3. A fuse according to claim 1, wherein for any two adjacent fusible strips, the first strip has a low melting alloy spot which is spaced from one end by between one fifth and two fifths of the length of the fusible strip, while the low melting alloy spot of the second strip is spaced from the other end by between one fifth and two fifths of the length of the fusible strip.

4. A fuse according to claim 1, wherein the distance from a low melting alloy spot to the closest end of the respective fusible strip is equal for all fusible strips.

5. A fuse according to claim 1, wherein a plurality of long and short reduced cross-sectional areas are provided along each strip.

6. A fuse according to claim 1, wherein the grains of sand have a diameter of between 300 and 600 microns.

7. A fuse according to claim 1, wherein the cross section of the first fusible strips is greater than the cross section of the second fusible strips.

8. A fuse according to claim 7, wherein the cross sectional area of the first fusible strips is between 10 and 25% less than the cross sectional area of the first fusible strips.

9. A fuse according to claim 1, wherein the spots of low melting alloy are spaced from the nearest end of the respective fusible strip by a distance of between one fifth and two fifths of the length of the respective strip.

* * * * *